US006024011A

United States Patent [19]

Bergmann

[11] Patent Number: 6,024,011

[45] Date of Patent: Feb. 15, 2000

[54] HYDROSTATIC AXIAL PISTON MACHINE

[75] Inventor: Martin Bergmann, Schaafheim, Germany

[73] Assignee: Linde Aktiengesellschaft, Germany

[21] Appl. No.: 09/184,481

[22] Filed: Nov. 2, 1998

[30] Foreign Application Priority Data

Nov. 24, 1997 [DE] Germany ..... 197 52 021

[51] Int. Cl.[7] ..... F01B 3/02

[52] U.S. Cl. ..... 92/71; 92/157

[58] Field of Search ..... 92/71, 129, 154, 92/157

[56] References Cited

U.S. PATENT DOCUMENTS 4,683,804 8/1987 Futamura et al. ..... 92/71

FOREIGN PATENT DOCUMENTS 156176 7/1991 Japan ..... 92/12.2

983310 2/1965 United Kingdom ..... 92/71

*Primary Examiner*—F. Daniel Lopez

*Attorney, Agent, or Firm*—Webb Ziesenheim Logsdon Orkin & Hanson, P.C.

[57] ABSTRACT

This invention relates to a hydrostatic axial piston machine that utilizes a swash plate construction with a plurality of axially movable pistons mounted in a cylinder drum. The pistons are each supported on a slide face by individual sliding blocks and are hydrostatically compensated. Each sliding block has a sliding block plate facing the slide face, and is in communication on the side opposite the sliding block plate with a piston. A sealing web is formed on the sliding block plate and the sliding block is provided with a bore that leads from the piston side to the slide face side. The sealing web on the sliding block plate of the sliding block is realized in the form of a substantially concave surface. In one configuration, the concave surface, starting from an outside periphery of the sliding block, extends substantially to the vicinity of the bore.

5 Claims, 4 Drawing Sheets

HYDROSTATIC AXIAL PISTON MACHINE

BACKGROUND OF THE INVENTION

1. Field of the Invention

This invention relates generally to a hydrostatic axial piston machine utilizing a swash plate construction having a plurality of pistons mounted so that they can move axially in a cylinder drum, each piston being supported on a slide face and hydrostatically compensated by an individual sliding block having a sliding block plate facing the slide face and which is connected to the piston on the side opposite the sliding block plate, with a sealing web formed on the sliding block plate and with the sliding block provided with a bore extending from the piston side of the sliding block to the slide face side.

2. Description of the Currently Available Technology

In known swash plate machines, the pistons are usually each supported by means of an individual sliding block on a slide face to reduce the friction forces between the pistons and the swash plate and thus to increase the efficiency of the machine. The slide face can be formed by a stationary or tilting swash plate and/or by a wear plate that is non-rotatably connected to the swash plate. Hydrostatic compensation occurs by means of a passage or bore in the sliding blocks, which bore extends from the area in contact with the piston to the area of the sliding block plate. The bore is in flow communication with a longitudinal bore in the piston through which hydraulic fluid can flow from the piston to the sliding block plate.

On a swash plate machine used as a hydraulic motor, there are stringent requirements in terms of the uniformity of the motion, primarily during start-up from a stop and during operation at low speeds. With a constant flow of hydraulic fluid flowing to the hydraulic motor, there will only be a uniform rotational movement if the change in the leakage at the sliding blocks is as small as possible over the angle of rotation of the hydraulic motor.

In known axial piston machines, the sliding block plate of the sliding block is flat. The sliding block plate has a pressure pocket that is in communication with the bore and has a sealing web that concentrically surrounds the pressure pocket. The sealing web, which simultaneously forms the bearing surface of the sliding block, is therefore flat and, in the unloaded condition, is oriented parallel to the slide face. To achieve a correspondingly low leakage at the sliding blocks, the sealing web of the sliding block is realized so that it is correspondingly wide.

During operation of a swash plate machine, friction occurs at the connecting point between the piston and the sliding block, e.g., a ball bearing, which generates a tilting moment that is exerted on the sliding block. This tilting moment can result in an inclined position of the sliding block with respect to the wear plate, which has an adverse effect on the quality of the seal and the magnitude of the friction on the sliding block. During the work stroke of the piston, the length of the piston that projects out of the cylinder drum also changes, as a result of which the support forces of the piston in the cylinder guide and the associated friction forces also change. The normal force applied to the sliding block is therefore not constant and changes over the stroke of the piston.

Under these conditions, a sliding block with a flat bearing surface behaves in the following manner. As a result of the tilting moment acting on the sliding block, the sliding block assumes a position in which it is tilted with respect to the slide face. The tilting of the sealing web of the sliding block with respect to the slide face results in an asymmetrical pressure profile under the sealing web, which results in a hydrostatic righting moment on the sliding block that is opposite to the tilting moment. Consequently, there are measures to counteract an increase in the leakage of hydraulic fluid and a tilting of the sliding block and the associated increase in the friction forces.

With such sliding blocks having a flat bearing surface and thus a flat sealing web, if the normal force pressing on the sliding block during a stroke of the piston decreases, the distance between the bearing surface of the sliding block and the slide face increases, as a result of which the height of a sealing gap between the sliding block and the slide face increases. The pressure profile in the sealing gap thereby changes only slightly over the height of the sealing gap, as a result of which the hydrostatic compensation force remains practically constant in spite of the change in the height of the sealing gap. As the height of the sealing gap increases, there is therefore a significant increase in the leakage between the sliding block and the slide face. Over the piston stroke, therefore, there is only one point at which the compensation of the sliding block specified by the designer can be achieved. At all the other operating points, the sliding block is either under-compensated, as a result of which the sliding block is pressed against the slide face and thus the friction increases, or the sliding block is over-compensated, as a result of which the sliding block lifts up away from the swash plate and the height of the sealing gap increases accordingly. The result is increased leakage, which leads to high leakage oil pulsation of the machine. As a result of this fluctuation of the leakage oil flow and the friction forces during one revolution of the cylinder drum, there is a non-uniform rotational movement of the machine.

To reduce this leakage oil pulsation, hold-down devices are required on the sliding blocks. However, such hold-down devices require a correspondingly precise adjustment and are expensive to manufacture. The leakage oil pulsation can be reduced by using a spring device to exert additional pressure on the sliding block, but that also results in increased friction.

A longitudinal section of a known axial piston machine in a conventional swash plate design used as a hydraulic motor is shown in FIG. 1. A cylinder drum 1 drives a connected output shaft 2. The cylinder drum 1 has a plurality of bores 3 located concentric to an axis of rotation 11 of the output shaft 2. A piston 4 is mounted in each bore 3 so that it can move longitudinally with respect to the cylinder drum 1. The pistons 4 are provided, on the end projecting out of the bore 3, for example, with a spherical head 5 which engages a spherical recess formed on a sliding block neck of a sliding block 6. The sliding block 6, on the side opposite the piston 4, has a sliding block plate 7 which is configured to abut a slide face 8, e.g., of a wear plate 12 that is fastened non-rotationally to a swash plate. A bore 9 located in the sliding block 6 is in flow communication with a longitudinal bore 10 in the piston 4, whereby hydraulic fluid can flow from the pressure chamber formed by the bore 3 and the piston 4 to the sliding block plate 7 and thus the piston 4 is hydrostatically compensated on the slide face 8.

FIG. 2 shows a detail of the sliding block 6 of FIG. 1. On the sliding block plate 7, there is a ring-shaped pressure pocket 16 that is in flow communication with the bore 9 oriented coaxially to an axis of symmetry 18. A sealing web 15, realized in the form of a flat surface, concentrically surrounds the pressure pocket 16. The width of the sealing web 15 is defined by the outside diameter $d_a$ and the inside diameter $d_i$ of the sealing web 15.

During the operation of an axial piston machine used as a hydraulic motor, a load is applied to the sliding block 6 in the form of a normal force $F_N$ which changes over the stroke of the piston 4. As a result of the application of the normal force $F_N$, friction occurs at the ball-and-socket joint between the piston 4 and the sliding block 6, which causes a tilting moment $M_R$ that acts on the sliding block 6 and causes it to assume a position that is tilted at an angle γ with respect to the slide face 8. The pressure profile 17 illustrated in the bottom portion of FIG. 2 thereby occurs on the sliding block 6. As a result of the inclined position of the sliding block 6 with respect to the slide face 8 and the resulting different distance of the sealing web 15 from the slide face 8, an asymmetrical pressure profile 17 is thereby formed under the sealing web 15. The result is a hydrostatic compensation force $F_E$ that is applied at a distance e from the axis of symmetry 18 of the sliding block 6. The compensating force $F_E$ therefore exerts a righting moment on the sliding block 6 that counteracts the tilting moment $M_R$. A sealing gap having a height s is defined between the slide face 8 and the sealing web 15.

It is an object of this invention to provide a hydrostatic axial piston machine that has low or reduced friction between the sliding blocks and the slide face and a low leakage oil pulsation as a result of the leakage at the sealing webs.

SUMMARY OF THE INVENTION

The invention teaches that this object may be accomplished when the sealing web on the sliding block plate of the sliding block is realized in the form of a substantially concave surface. This results in a large change in the throttle cross section over the diameter of the sliding block as a function of the height of the sealing gap, a result of which the hydrostatic compensating force that is exerted on the sliding blocks during the operation of the axial piston machine is a function of the height of the sealing gap that occurs at the sealing web of the sliding block. If the normal force applied to the sliding block during a stroke of the piston thereby decreases, the height of the sealing gap increases. The result, however, is a simultaneous reduction of the compensating force as a result of the modified pressure distribution in the sealing gap. An equilibrium is thus established between the normal force being exerted on the sliding block and the compensating force. The result is only a slight increase in the height of the sealing gap and thus of the leakage that occurs at the sealing gap. When there is an increase in the normal force, the height of the sealing gap decreases, and the compensating force increases. The friction thereby increases not at all or only slightly. When there is a tilting moment that causes a tilting of the sliding block, there is a righting moment that occurs, analogous to the situation on a sliding block that has a flat bearing surface. As a result of the dependence of the compensating force on the height of the sealing gap, there is thus a low leakage oil pulsation in the operation of the displacement unit. Thus there is a uniform rotational movement of the cylinder drum of the machine. There is also a reduced fluctuation of the torque compared to a displacement unit that has a sliding block with a flat bearing surface. As a result of the reduced friction between the sliding blocks and the slide face, there is a further increase in the efficiency of a displacement unit of the invention.

It is particularly advantageous if the concave surface begins at the outside periphery or diameter of the sliding block and extends into the vicinity of the bore in the sliding block. Almost the entire surface of the sliding block plate is therefore active as the sealing web.

The concave surface of the sealing web can assume different shapes. For example, the sealing web viewed in the longitudinal section of the sliding block can be realized in the shape of a parabola. In one particularly advantageous configuration of the invention, the concave surface of the sealing web is realized in the form of a conical surface. The sealing web is therefore realized in the form of the curved surface of a cone. This configuration is more economical to manufacture, because such a conical surface can easily be manufactured on the sliding block plate of the sliding block.

The use of a hydrostatic axial piston machine of the invention as a hydraulic motor is particularly advantageous because, as a result of the low friction forces involved, the efficiency of the hydraulic motor can be improved and, as a result of the reduced leakage oil pulsation, the uniformity of motion of the hydraulic motor increases. As a result of which, there is an improved operating action of the hydraulic motor during start-up from a stop and at low speeds.

BRIEF DESCRIPTION OF THE DRAWINGS

Additional advantages and details of the invention are explained in greater detail below with reference to the exemplary embodiments illustrated schematically in the accompanying drawings, in which.

DESCRIPTION OF THE PREFERRED EMBODIMENTS

Figure 3:
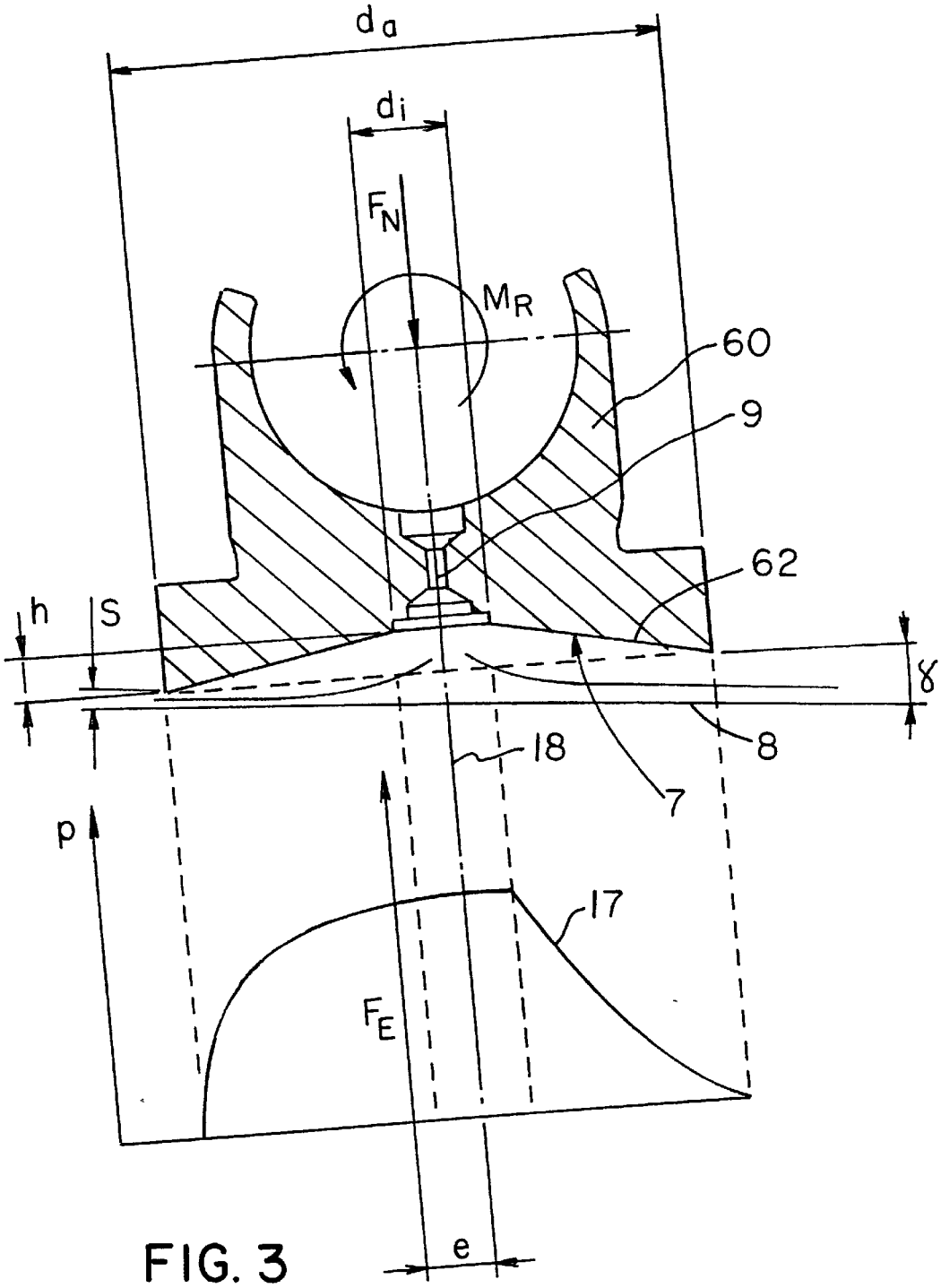
FIG. 3 is a sectional view of a sliding block of the invention with the pressure profile that occurs during operation.

FIG. 3 shows a detail of a sliding block 60 used in an axial piston machine incorporating the features of the invention. The sealing web 62 is realized in the form of a substantially tapered or concave surface. An inside diameter $d_i$ of the sealing web 62 can extend into the vicinity of the bore 9 that is located concentric to the axis of symmetry 18. The concave surface is preferably realized in the form of the curved surface of a cone that has a defined height h, and simultaneously forms the hollow portion of the concave surface and thus of the web 62. Consequently, there is formed a sealing web 62 that is curved toward the piston. The bottom portion of FIG. 3 shows the pressure profile that occurs under the sealing web 62 and the resulting compensating force $F_E$ which, as a result of the tilted position of the sliding block 60, is separated by the angle γ and the resulting asymmetrical profile under the sealing web 62 by a distance e from the axis of symmetry 18. The compensating force $F_E$ can thus effect a righting moment that counteracts the tilted position of the sliding block 60 with respect to the slide face 8 caused by the tilting moment $M_R$.

Figure 1:
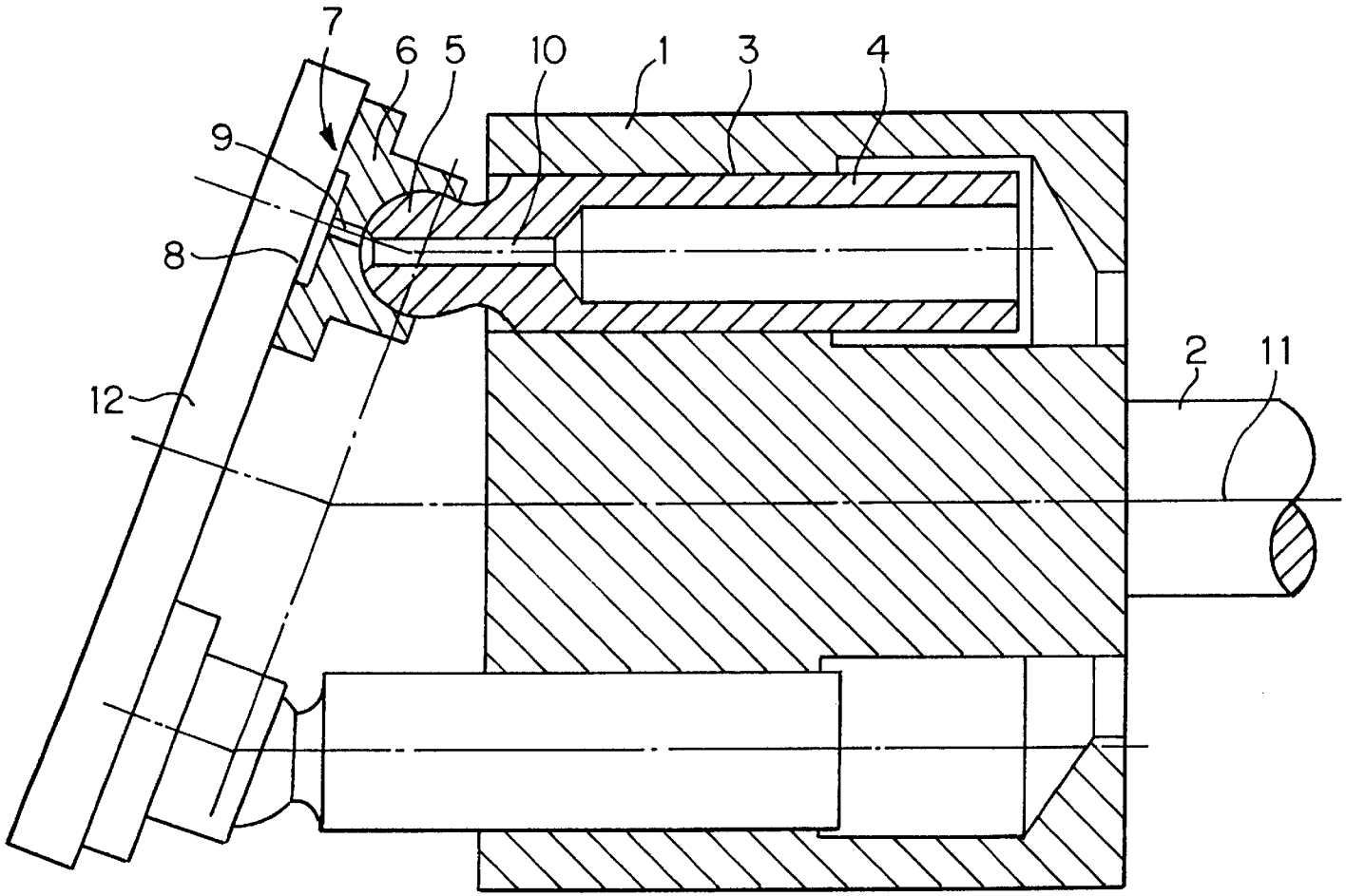
FIG. 1 PRIOR ART
FIG. 1 is a longitudinal section of a known axial piston machine.
Figure 2:
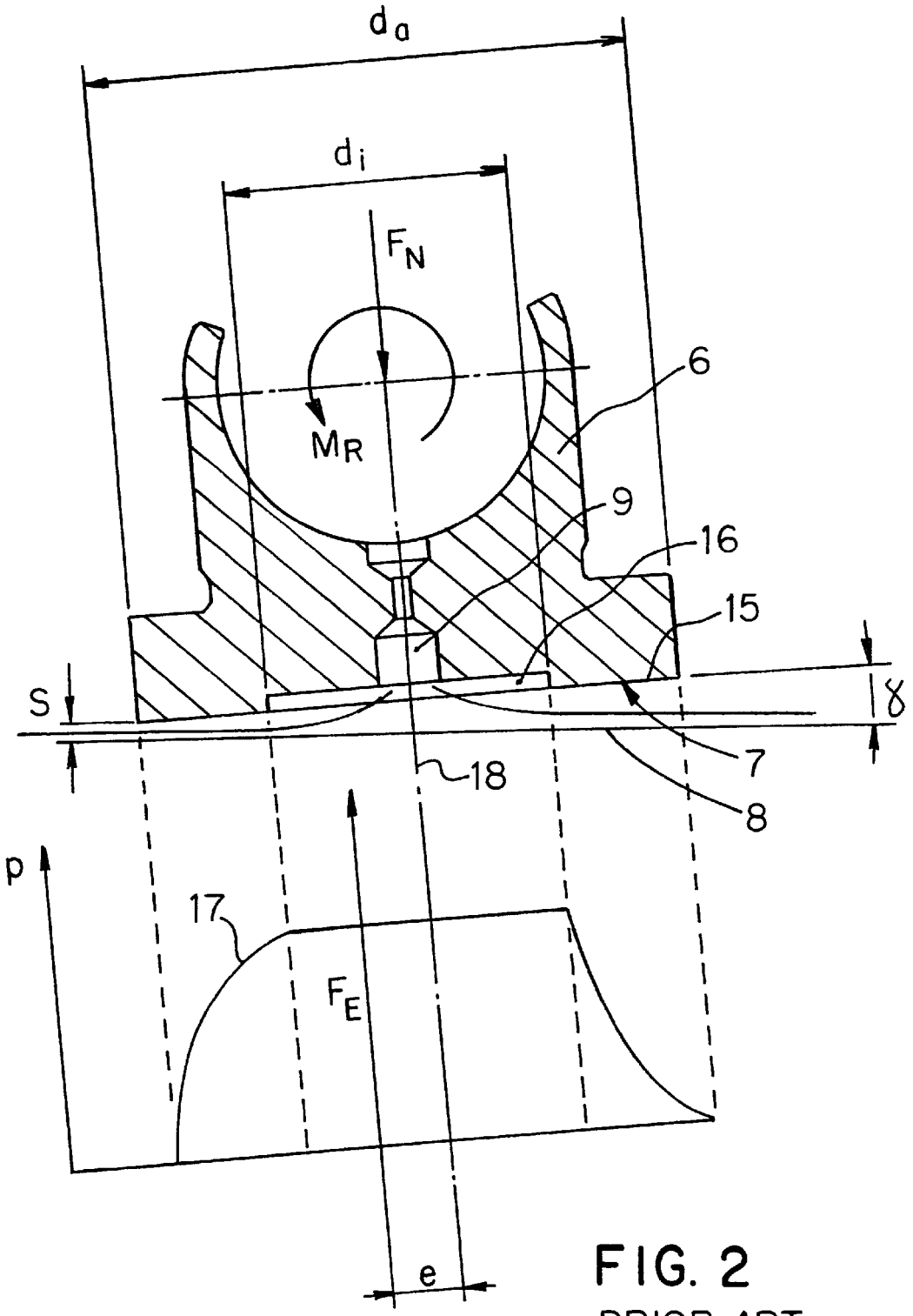
FIG. 2 PRIOR ART
FIG. 2 is a sectional view of a sliding block used in the machine shown in FIG. 1, with the forces and moments acting on the sliding block, as well as the pressure profile that results.
Figure 4:
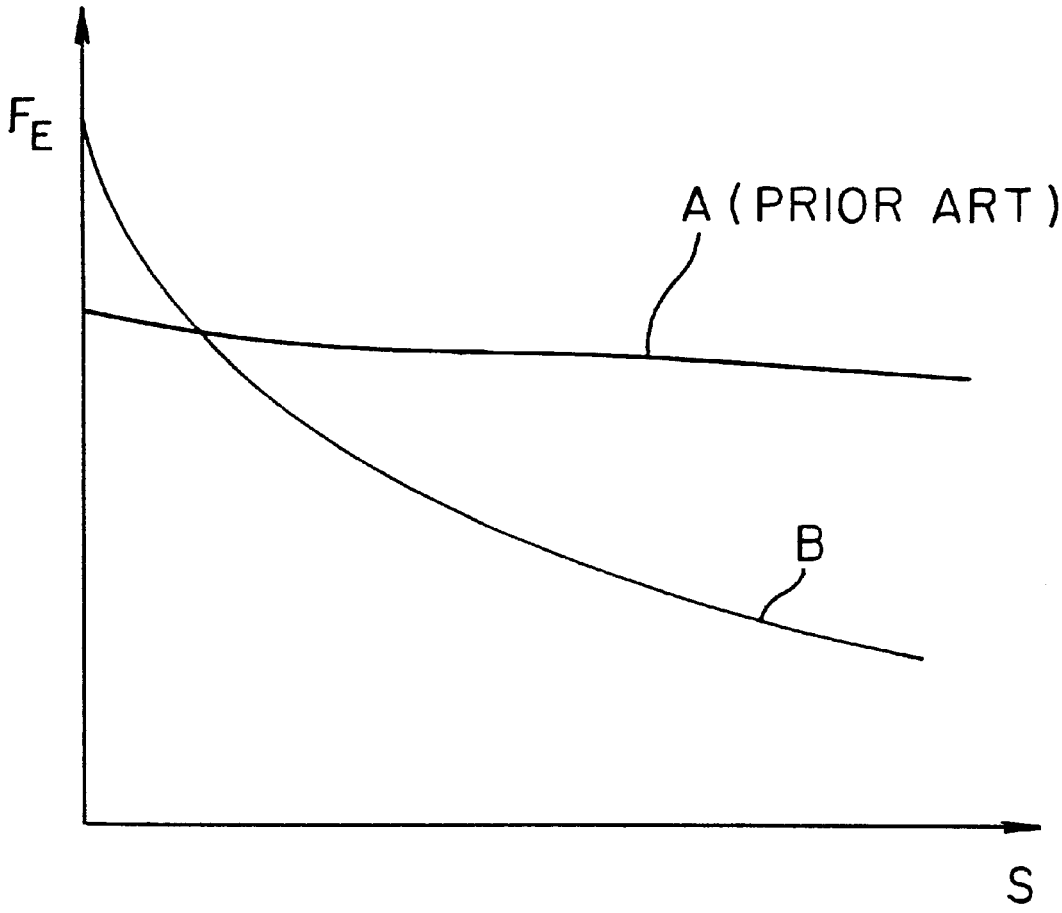
FIG. 4 is a graph qualitatively showing the relationship between the compensating force with respect to the height of the sealing gap of the sliding blocks illustrated in FIGS. 2 and 3.

FIG. 4 is a qualitative graph of the compensating force $F_E$ over the height s of the sealing gap between the sealing web 62 and the slide face 8 for a known sliding block 6 and also for a sliding block 60 of the invention. The height s of the sealing gap is plotted on the abscissa, and the compensating forces $F_E$ of a sliding block 6 of the prior art as illustrated in FIG. 2 (Curve A) and of a sliding block 60 as illustrated in FIG. 3 (Curve B) are plotted on the ordinate. The graph qualitatively shows that with a sliding block 6 of the prior art (Curve A), the compensating force is almost constant with increasing height s of the sealing gap, whereby the behavior of such a sliding block 6 as described occurs when there is a changing normal force $F_N$. With a sliding block 60 as illustrated in FIG. 3 (Curve B), the compensating force $F_E$ decreases with increasing height s of the sealing gap.

When there is an increase in the normal force $F_N$ during a stroke of the piston and a related reduction of the height s of the sealing gap, the compensating force $F_E$ thereby increases. This is to prevent the sliding block 60 from coming into contact with the slide face 8 and thus increasing the friction. When there is a decrease in the normal force $F_N$ being exerted on the sliding block 60 during the piston stroke, the height s of the sealing gap increases, as a result of which there is a reduction of the compensating force $F_E$. An equilibrium is thereby established between the compensating force $F_E$ and the normal force $F_N$ being exerted on the piston, as a result of which there is only a slight increase in the height s of the sealing gap. The result is only a slight increase in the leakage between the sliding block 60 and the slide face 8 during the work stroke of the piston, as a result of which there is a low leakage oil pulsation. During a work stroke of the piston, therefore, the change in the normal force $F_N$ being exerted on the piston can be compensated by the sliding block 60, whereby on one hand, the friction forces between the sliding block and the swash plate, and on the other hand the leakage oil pulsation is reduced. The result is an axial piston machine with improved efficiency and an improved uniformity of motion, primarily during start-up from a stop and operation at low speeds, when the axial piston machine is being used as a hydraulic motor.

The axial piston machine of the invention can be realized with a stationary swash plate and a rotating cylinder block or, alternatively, with a stationary cylinder block and a rotating swash plate. The swash plate can also be modified in terms of the angle it assumes with respect to a plane perpendicular to the axis of rotation of the axial piston machine.

As will be readily appreciated by those skilled in the art that modifications may be made to the invention without departing from the concepts disclosed in the foregoing description. Such modifications are to be considered as included within the scope of the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

I claim:

1. A hydrostatic axial piston motor, comprising:

a plurality of axially movable pistons mounted in a cylinder drum, each piston having a bore in flow communication with a pressure chamber, wherein each piston is supported on a slide face by an associated sliding block and is hydrostatically compensated, wherein each sliding block has a sliding block plate facing the slide face and is in communication on a side opposite the sliding block plate with an associated piston, wherein a sealing web is formed on the sliding block plate, wherein each sliding block includes a bore extending from a piston side to a sliding block plate side of the sliding block, the sliding block bore being in flow communication with the piston bore of the associated piston such that hydraulic fluid can flow from the pressure chamber so that each piston is hydrostatically compensated on an associated sliding block, wherein the sealing web includes a substantially concave surface, and wherein each sliding block has an outside perimeter, with the concave surface of the sealing web starting from the outside perimeter of the sliding block and extending substantially continuously to the bore of the sliding block.

2. The hydrostatic axial piston motor as claimed in claim 1, wherein the sealing web is configured as a conical surface.

3. A hydrostatic axial piston motor, comprising:

a cylinder drum having a plurality of axially movable pistons, each piston having a bore in flow communication with a pressure chamber;

a sliding block mounted on an outer end of each piston, each sliding block including a sealing web having a non-planar surface, wherein each sliding block includes a bore in flow communication with the piston bore of the associated piston such that hydraulic fluid can flow from the pressure chamber so that each piston is hydrostatically compensated on an associated sliding block, and wherein the sealing web has an inner periphery and an outer periphery, with the sealing web tapered substantially continuously from the inner periphery to the outer periphery.

4. The hydrostatic axial piston motor as claimed in claim 3, wherein the non-planar surface is substantially concave.

5. The hydrostatic axial piston motor as claimed in claim 3, wherein the non-planar surface is substantially conical.

* * * * *